US008820522B2

(12) United States Patent
Quarry et al.

(10) Patent No.: US 8,820,522 B2
(45) Date of Patent: Sep. 2, 2014

(54) APPARATUS AND KIT FOR CONTAINING SPORTS EQUIPMENT

(76) Inventors: Brendan E. Quarry, Delta (CA); Alvin E. Clemens, Vancouver (CA)

( * ) Notice: Subject to any disclaimer, the term of this patent is extended or adjusted under 35 U.S.C. 154(b) by 26 days.

(21) Appl. No.: 13/324,119

(22) Filed: Dec. 13, 2011

(65) Prior Publication Data

US 2012/0145718 A1 Jun. 14, 2012

Related U.S. Application Data

(60) Provisional application No. 61/422,771, filed on Dec. 14, 2010.

(30) Foreign Application Priority Data

Jan. 13, 2011 (CA) ..... 2727882

(51) Int. Cl.
*A45C 5/00* (2006.01)
*A45C 13/02* (2006.01)
(Continued)

(52) U.S. Cl.
CPC ..... *A45C 5/04* (2013.01); *A45C 13/008* (2013.01); *A45C 11/20* (2013.01); *A45F 3/46* (2013.01); *A45C 2200/10* (2013.01); *A45C 2011/007* (2013.01); *A45C 13/02* (2013.01); *A63B 71/0036* (2013.01); *A45C 2013/026* (2013.01); *A45C 2003/007* (2013.01); *A45C 15/00* (2013.01); *A45C 5/14* (2013.01)
USPC ..... 206/315.1; 220/529; 220/9.1; 220/476; 220/480; 383/38; 190/102; 190/109; 190/110; 116/63 C; 116/63 R

(58) Field of Classification Search
CPC ..... B65D 75/00; B65D 30/22; B65D 30/16; B65D 65/00
USPC ..... 220/529, 89, 23.6, 737, 738, 23.83, 9.1, 220/9.2, 9.3, 528, 481, 480; 206/315.1, 206/587, 434, 446; 414/30, 126; 383/38, 383/121.1; 224/579, 585, 275; 190/109, 190/110, 102; 116/63 C, 63 R
See application file for complete search history.

(56) References Cited

U.S. PATENT DOCUMENTS 476,598 A * 6/1892 Bancroft ..... 190/33
(Continued)

FOREIGN PATENT DOCUMENTS

CA 2542262 A1 10/2007
(Continued)

OTHER PUBLICATIONS

Maudesport online catalogue: http://web.archive.org/web/20100328144556/http://www.maudesport.com/ancillary_products_sports_equipment_storage_mobility_541_category. Dated Mar. 28, 2010.
(Continued)

*Primary Examiner* — Mickey Yu
*Assistant Examiner* — Gideon Weinerth
(74) *Attorney, Agent, or Firm* — Smiths IP

(57) ABSTRACT

An apparatus for containing sports equipment includes: a wall defining an enclosure and a closeable opening in the enclosure, the wall being see-through at the closeable opening; and divider members configurable to an expanded configuration defining compartments within the enclosure and configurable to a substantially planar collapsed configuration, each compartment being dimensioned for receiving sports equipment, the divider members being removably insertable into the enclosure when in the expanded configuration and in the collapsed configuration. The sports equipment includes soccer balls or other types of balls, marker cones, a first aid kit, cooler for ice and pinnies. A lower section of the apparatus has a see-through front cover and a drain. An upper section may be watertight. The apparatus may include a rigid cylindrical compartment for containing marker cones. A kit may include the apparatus and sports equipment contained within the apparatus.

9 Claims, 6 Drawing Sheets

(51) Int. Cl.

| | |
|---|---|
| ***A45C 11/20*** | (2006.01) |
| ***A45F 3/46*** | (2006.01) |
| ***A45C 5/04*** | (2006.01) |
| ***A45C 15/00*** | (2006.01) |
| ***A45C 5/14*** | (2006.01) |
| *A45C 13/00* | (2006.01) |
| *A45C 11/00* | (2006.01) |
| *A63B 71/00* | (2006.01) |
| *A45C 3/00* | (2006.01) |

(56) References Cited

U.S. PATENT DOCUMENTS

| | | | | | |
|---|---|---|---|---|---|
| 948,524 | A | * | 2/1910 | Reid | 294/143 |
| 1,139,128 | A | * | 5/1915 | Lindberg | 206/589 |
| 1,628,718 | A | * | 5/1927 | Fritzsche | 206/589 |
| 1,915,958 | A | * | 6/1933 | Skirrow | 248/300 |
| 2,333,273 | A | * | 11/1943 | Scanlon | 116/63 R |
| 2,343,763 | A | * | 3/1944 | Fridolph | 312/306 |
| 2,517,757 | A | * | 8/1950 | Adlerstein | 312/3 |
| 3,292,747 | A | | 12/1966 | Dawson | |
| 3,343,671 | A | * | 9/1967 | Weinstein | 206/499 |
| 3,732,955 | A | * | 5/1973 | Carter et al. | 190/109 |
| 3,883,029 | A | * | 5/1975 | Wyatt | 220/23.83 |
| 3,963,102 | A | * | 6/1976 | Carp | 190/108 |
| 4,212,377 | A | * | 7/1980 | Weinreb | 190/109 |
| 4,219,141 | A | * | 8/1980 | Lovy | 224/545 |
| 4,506,769 | A | * | 3/1985 | Franco et al. | 190/108 |
| 4,597,706 | A | * | 7/1986 | Michit | 414/788.2 |
| 4,602,715 | A | * | 7/1986 | Sarver et al. | 206/523 |
| 4,621,764 | A | * | 11/1986 | Ragon | 229/120.31 |
| 4,708,248 | A | * | 11/1987 | Davis | 206/549 |
| 4,798,319 | A | | 1/1989 | James, Jr. | |
| 4,823,956 | A | * | 4/1989 | Belisle | 206/523 |
| 4,981,232 | A | * | 1/1991 | Wynn | 220/532 |
| 5,042,664 | A | * | 8/1991 | Shyr et al. | 206/579 |
| 5,051,725 | A | | 9/1991 | Caccitolo | |
| 5,052,580 | A | * | 10/1991 | Khoury | 220/505 |
| 5,092,480 | A | * | 3/1992 | Waterston | 220/23.4 |
| 5,244,334 | A | * | 9/1993 | Akita et al. | 414/502 |
| 5,282,598 | A | * | 2/1994 | Greene | 248/311.2 |
| 5,323,897 | A | * | 6/1994 | Sperber | 206/287 |
| 5,381,922 | A | * | 1/1995 | Gladman et al. | 220/481 |
| 5,413,199 | A | * | 5/1995 | Clement | 190/108 |
| 5,433,230 | A | * | 7/1995 | Miller | 134/110 |
| 5,447,216 | A | * | 9/1995 | Freyvogel | 190/18 A |
| 5,511,666 | A | | 4/1996 | Grip | |
| 5,553,707 | A | | 9/1996 | Lion | |
| 5,624,032 | A | * | 4/1997 | Yucknut et al. | 206/433 |
| 5,630,537 | A | * | 5/1997 | Sciacca | 224/629 |
| 5,667,082 | A | | 9/1997 | Hamilton et al. | |
| 5,732,847 | A | * | 3/1998 | Caldi | 220/575 |
| 5,758,513 | A | * | 6/1998 | Smith | 62/457.5 |
| 5,794,747 | A | * | 8/1998 | Bryant | 190/18 R |
| 5,806,981 | A | * | 9/1998 | Schisler | 383/38 |
| 5,833,056 | A | * | 11/1998 | Goldman | 206/199 |
| 5,845,780 | A | * | 12/1998 | Allen | 206/579 |
| 5,951,075 | A | | 9/1999 | Green | |
| 5,975,293 | A | * | 11/1999 | Fowler | 206/315.9 |
| 6,092,654 | A | * | 7/2000 | Webb | 206/320 |
| 6,109,404 | A | * | 8/2000 | Bishop | 190/125 |
| 6,129,232 | A | * | 10/2000 | Williams | 220/521 |
| 6,138,882 | A | * | 10/2000 | Buettner | 224/250 |
| D446,936 | S | * | 8/2001 | Sanderson et al. | D3/289 |
| 6,321,929 | B1 | * | 11/2001 | Weshler et al. | 220/555 |
| 6,467,665 | B1 | | 10/2002 | Jenkins | |
| 6,561,329 | B2 | * | 5/2003 | Helmsworth et al. | 190/112 |
| 6,612,434 | B1 | * | 9/2003 | Redzisz | 206/315.11 |
| 6,640,944 | B2 | * | 11/2003 | Adams | 190/110 |
| 6,752,582 | B2 | * | 6/2004 | Garcia | 414/467 |
| 6,763,940 | B1 | | 7/2004 | Lai | |
| 6,769,588 | B2 | * | 8/2004 | Zheng | 224/576 |
| 6,820,878 | B2 | * | 11/2004 | Safari et al. | 280/47.26 |
| 6,910,560 | B2 | * | 6/2005 | Dulin | 190/109 |
| 6,945,442 | B2 | * | 9/2005 | Godshaw et al. | 224/607 |
| 6,966,450 | B2 | * | 11/2005 | Askew | 220/529 |
| 7,234,630 | B2 | * | 6/2007 | Wang | 229/120.31 |
| D550,963 | S | * | 9/2007 | Eskandry | D3/307 |
| 7,334,669 | B2 | * | 2/2008 | Barker et al. | 190/104 |
| 7,334,684 | B1 | * | 2/2008 | Fontanilla et al. | 206/541 |
| 7,419,037 | B2 | * | 9/2008 | Nordstrom | 190/107 |
| 7,549,415 | B2 | | 6/2009 | Karellas | |
| 7,565,974 | B2 | * | 7/2009 | Adams, Jr. | 206/427 |
| 7,600,619 | B2 | * | 10/2009 | Sapyta | 190/107 |
| 7,621,421 | B2 | * | 11/2009 | Ohayon | 220/529 |
| 7,841,467 | B2 | * | 11/2010 | Slayton | 206/315.1 |
| 8,272,505 | B2 | * | 9/2012 | Melamed | 206/6.1 |
| 2002/0038745 | A1 | * | 4/2002 | Lamming | 190/125 |
| 2002/0144916 | A1 | * | 10/2002 | Cheng | 206/315.1 |
| 2003/0103691 | A1 | * | 6/2003 | Adams | 383/38 |
| 2003/0209396 | A1 | * | 11/2003 | Bernbaun et al. | 190/18 A |
| 2003/0221978 | A1 | * | 12/2003 | Redzisz | 206/278 |
| 2004/0045780 | A1 | * | 3/2004 | Bernbaum et al. | 190/109 |
| 2004/0188963 | A1 | | 9/2004 | Gant | |
| 2005/0034947 | A1 | | 2/2005 | Nykoluk | |
| 2005/0056655 | A1 | * | 3/2005 | Gary | 220/737 |
| 2005/0126872 | A1 | * | 6/2005 | Dror | 190/107 |
| 2006/0011686 | A1 | * | 1/2006 | Latham | 224/579 |
| 2006/0037825 | A1 | * | 2/2006 | Dayton et al. | 190/110 |
| 2006/0137949 | A1 | * | 6/2006 | Levinson et al. | 190/18 A |
| 2007/0227922 | A1 | * | 10/2007 | Chappell et al. | 206/315.1 |
| 2007/0235490 | A1 | * | 10/2007 | Katz et al. | 224/579 |
| 2008/0223677 | A1 | | 9/2008 | Mauro | |
| 2009/0032418 | A1 | * | 2/2009 | Hamilton | 206/315.9 |
| 2009/0223850 | A1 | * | 9/2009 | Katzauer et al. | 206/427 |
| 2010/0078280 | A1 | * | 4/2010 | Mauro | 190/18 A |
| 2010/0108703 | A1 | * | 5/2010 | French | 220/737 |
| 2010/0200584 | A1 | * | 8/2010 | Lemke et al. | 220/23.83 |
| 2010/0300906 | A1 | * | 12/2010 | Moore | 206/315.1 |
| 2011/0168587 | A1 | * | 7/2011 | Bunn | 206/315.1 |
| 2014/0027223 | A1 | * | 1/2014 | Moore | 190/102 |

FOREIGN PATENT DOCUMENTS

| | | | |
|---|---|---|---|
| CA | 2581636 | A1 | 9/2008 |
| EP | 0924142 | A1 | 6/1999 |
| GB | 553410 | | 5/1943 |
| GB | 2200338 | A | 8/1988 |
| GB | 2335182 | A | 9/1999 |
| JP | 09124042 | A | 5/1997 |

OTHER PUBLICATIONS

Valentine Sports online catalogue: http://web.archive.org/web/20101201135831/http://www.valentinesports.co.uk/c-361-sports-storage-for-schools.aspx. Dated Dec. 1, 2010.

* cited by examiner

APPARATUS AND KIT FOR CONTAINING SPORTS EQUIPMENT

CROSS-REFERENCE TO RELATED APPLICATIONS

This application claims priority of the U.S. provisional application No. 61/422,771 filed Dec. 14, 2010 and the Canadian patent application No. 2727882 filed Jan. 13, 2011, the entire contents of both of which are hereby incorporated by reference.

BACKGROUND OF THE INVENTION

1. Field of Invention

This invention relates to sports bags, sacks, cases, luggage, baggage, trunks, chests, boxes, storage carts, bins and other containment systems and, in particular, to an apparatus and kit for containing sports equipment.

2. Description of Related Art

Various combinations of general purpose mesh bags, zippered sacks and plastic storage bins have been used by sports coaches for transporting sports equipment, such as soccer balls and other types of balls, pinnies, cones, corner flags, field markers, goal markers, goal pieces, goal nets, goal net fasteners, ball pumps, goalie gloves and other athletic wear accessories, player cards, first aid kits, coolers, ice for first aid treatment, gel packs for first aid treatment and other items useable for coaching sports, to and from a sports field or other facility.

However, such general purpose bags, sacks and bins lack compartmentalization adequate to maintain the various types of sports equipment contained therein in an organized state during transportation.

An object of the invention is to address the above shortcoming.

SUMMARY

The above shortcoming may be addressed by providing, in accordance with one aspect of the invention, an apparatus for containing sports equipment. The apparatus includes: (a) at least one wall forming an enclosure; and (b) at least one closeable opening for providing access to the interior of said enclosure.

The interior of said enclosure may be compartmentalized. The apparatus may be dimensioned to define at least one compartment within said enclosure. The apparatus may be dimensioned such that said at least one compartment is dimensioned for receiving sports equipment. Said at least one compartment may be dimensioned for receiving a sports ball. Said at least one compartment may be dimensioned for receiving a soccer ball. Said at least one compartment may be dimensioned for receiving a foot ball. Said at least one compartment may be dimensioned for receiving a rugby ball. Said at least one compartment may be dimensioned for receiving a volley ball. Said at least one compartment may be dimensioned for receiving a basket ball. Said at least one compartment may be dimensioned for receiving a plurality of balls. Said at least one compartment may be dimensioned for receiving at least one item of said sports equipment. Said item may be selected from the group consisting of balls, pinnies, cones, corner flags, field markers, goal markers, goal pieces, goal nets, goal net fasteners, ball pumps, goalie gloves and other athletic wear accessories, player cards, first aid kit, coolers, ice and gel packs. The apparatus may include a cooler.

Said at least one compartment may have a substantially rectangular shape. Said at least one compartment may have a substantially cylindrical shape.

The apparatus may include at least one divider for defining said at least one compartment. Said at least one divider may be dimensioned for defining a plurality of said at least one compartments on opposing sides of said at least one divider. Said at least one divider may be substantially planar. Said at least one divider may be substantially rectangular. Said at least one divider may be semi-rigid. Said at least one divider may be rigid. Said at least one divider may be comprised of a plastic material. Said at least one divider may include plastic-covered cardboard. Said at least one divider may be comprised of a fabric-covered plastic.

Said at least one divider may be removable. Said at least one divider may be removably attachable to said at least one wall. The apparatus may include a fastener for removably attaching said at least one divider to said at least one wall. Said fastener may include at least one of a hook-and-loop type fastener, a zipper, a button, a clip, a clamp, a strap, a belt and a draw-string. Said at least one divider may include a fastener member for removably attaching said at least one divider to said at least one wall. The apparatus may include a pair of cooperating fastener members, a first member of said pair being attached to said at least one divider and a second member of said pair being attached to said at least one wall.

Said at least one divider may include a plurality of cooperating divider members, each said divider member having a cooperating slot therein such that said plurality of cooperating divider members are operable to removably engage one another. Said plurality of cooperating divider members may be operable to engage one another so as to form perpendicular divider sections. Said cooperating divider members may be uniformly dimensioned for ease of stacking said plurality of cooperating divider members. Said cooperating divider members may be dimensioned such that said plurality of cooperating divider members are stackable when not being engaged. Said cooperating divider members may be dimensioned so as to be stackable within said enclosure.

The apparatus may be collapsible. The apparatus may be collapsible when said at least one divider is not fastened to said at least one wall. The apparatus may be collapsible when said at least one divider is not attached to said at least one wall. The apparatus may be collapsible when said at least one divider is disposed within said enclosure. The apparatus may be collapsible when said plurality of cooperating divider members is disposed within said enclosure. The apparatus may be collapsible when said plurality of cooperating divider members is stacked within said enclosure. The apparatus may be substantially planar and rectangular when collapsed.

Said at least one wall may be comprised of a rigid material. Said at least one wall may be comprised of a semi-rigid material. Said at least one wall may be comprised of a plastic material. Said at least one wall may be comprised of a non-rigid material. Said at least one wall may be comprised of a fabric. Said at least one wall may be comprised of a mesh. Said at least one wall may be opaque. Said at least one wall may be see-through.

The apparatus may include one or more of a rear wall, a top wall, one or more side walls, a bottom wall and a front wall. Said closeable opening may include said at least one wall and an opening fastener. Said opening fastener may include at least one of a zipper, a hook-and-loop type fastener, a button, a clip, a clamp, a strap, a belt and a draw-string.

The apparatus may include a backing attached to said rear wall. Said backing may be attached to said rear wall within said rear wall. Said backing may be attached to said rear wall within said enclosure. Said backing may be semi-rigid. Said backing may be rigid. Said backing may be comprised of a plastic material. Said top wall may be attached to said rear wall along a top edge of said rear wall. Said bottom wall may be attached to said rear wall along a bottom edge of said rear wall. Each said one or more side walls may be attached to said rear wall along a side edge of said rear wall.

The apparatus may include a handle. Said handle may be a telescoping handle. Said handle may be a flip-type handle. Said handle may be attached to said at least one wall. Said handle may be slidably attached to said at least one wall. Said handle may be operable to extend from the apparatus substantially along a plane parallel to the plane of said rear wall. Said handle may be rigid. Said handle may be semi-rigid. Said handle may be flexible.

The apparatus may include one or more wheels. At least one said wheel may have all-terrain tread. The apparatus may include supporting feet. The apparatus may be operable to stand upright.

The apparatus may include a pocket. Said pocket may be attached to said at least one wall. Said pocket may be accessible from the interior of said enclosure. Said pocket may be accessible from the exterior of said enclosure. Said pocket may define a pocket opening. Said pocket may include a flap for covering said pocket opening. Said pocket may be closeable. Said pocket may include a pocket fastener. Said pocket fastener may be attached to said flap. Said pocket fastener may include at least one of a zipper, a hook-and-loop type fastener, a button, a clip, a clamp, a strap, a belt and a draw-string.

The apparatus may include a drain. Said drain may be formed of an opening disposed at the rear of the apparatus. Said drain may be formed of an opening disposed at the bottom of the apparatus. Said drain may include a channel formed within said enclosure. Said drain may include a grommet disposed within said opening. Said drain may include a mesh cover. Said mesh cover may be attached to at least one of said rear wall and said bottom wall. The apparatus may include a splash guard disposed adjacently to said drain.

Said at least one divider may be dimensioned to define a plurality of compartments on one side of said at least one divider. Said at least one divider may be permanently attached to said at least one wall. The apparatus may include a wall connecting fastener for connecting said at least one wall to another of said at least one wall. Said wall connecting fastener may include one or more of a hinge, zipper, hook-and-loop fastener, button, clip, clamp, strap, belt, draw-string and elastic. Said hinge may be operable to hingedly connect said rear wall to said top wall. Said rear wall may be integrally connected to said top wall. Said rear wall may be integrally and flexibly connected to said top wall. The apparatus may include a front wall. The front wall may be rigid. The front wall may be semi-rigid. Said at least one divider may be removably insertable within said enclosure such that a perimeter of said at least one divider contiguously contacts adjacent edges of said front wall, said side walls and said rear wall. The apparatus may be dimensioned for interfitting when being stacked with another of the apparatus.

In accordance with another aspect of the invention, there is provided an apparatus for containing sports equipment, the apparatus comprising: (a) at least one wall defining an enclosure and a closeable opening in the enclosure, the at least one wall being see-through at the closeable opening when the closeable opening is closed; and (b) a plurality of divider members configurable to an expanded configuration defining within the enclosure a plurality of compartments and configurable to a substantially planar collapsed configuration, each of the compartments being dimensioned for receiving at least one item of the sports equipment, the divider members being removably insertable into the enclosure when in the expanded configuration and when in the collapsed configuration.

At least one of the divider members may be removably attachable to the at least one wall. The at least one wall may include a front wall opposite a rear wall and a pair of opposing side walls extending between the front wall and the rear wall, the front wall defining the closeable opening, the at least one divider member being removably attachable to at least one of the opposing side walls, the apparatus comprising a fastener for removably attaching the at least one divider member to the at least one side wall. The plurality of divider members may include a second plurality of divider members foldably attached to each other. The apparatus may include a section wall attached to the at least one wall for dividing the enclosure into first and second sections defined on opposing sides of the section wall, the plurality of divider members comprising a plurality of first section divider members for defining a plurality of first section compartments within the first section and a second section divider member for defining a plurality of second section compartments within the second section, the front wall defining a first section closeable opening for providing access to the interior of the first section and a second section closeable opening for providing access to the interior of the second section. The front wall may include a first section front cover defining the first section closeable opening and a second section front cover defining the second section closeable opening, the first section front cover being see-through when the first section closeable opening is closed. The plurality of first section divider members may include the second plurality of foldably attached divider members. The apparatus may include a drain disposed at a bottom end of the apparatus. The second section may be watertight. The apparatus may include a plurality of wheels disposed at the bottom end of the apparatus and a handle disposed at a top end opposite the bottom end of the apparatus, the apparatus being operable to stand upright on the bottom end. The apparatus may be collapsible when the plurality of divider members is not in the expanded configuration. The apparatus may include a pocket accessible from the exterior of the enclosure.

In accordance with another aspect of the invention, there is provided an apparatus for containing sports equipment. The apparatus includes enclosure means for enclosing said sports equipment; and access means for permitting access to said enclosure means. The apparatus may include divider means for defining compartments within said enclosure means.

In accordance with another aspect of the invention, there is provided a kit. Said kit may be a sports equipment transportation kit. Said kit may include an apparatus for containing sports equipment; and at least one item of said sports equipment.

In accordance with another aspect of the invention, there is provided a sports kit comprising sports equipment and an apparatus for containing the sports equipment, the apparatus comprising: (a) at least one wall defining an enclosure and a closeable opening in the enclosure, the at least one wall being see-through at the closeable opening when the closeable opening is closed; and (b) a plurality of divider members configurable to an expanded configuration defining within the enclosure a plurality of compartments and configurable to a substantially planar collapsed configuration, each of the compartments being dimensioned for receiving at least one item of the sports equipment, the divider members being removably insertable into the enclosure when in the expanded configuration and when in the collapsed configuration.

The sports equipment may include an item selected from the group consisting of a ball, pinny, marker cone, corner flag, field marker, goal marker, goal piece, goal net, goal net fastener, ball pump, pair of goalie gloves, first aid kit, cooler, gel pack and a player card. The item may be a soccer ball.

In accordance with another aspect of the invention, there is provided an apparatus for containing sports equipment, the apparatus comprising: (a) a bottom wall, a top wall and at least one side wall extending between the bottom wall and the top wall so as to define an enclosure, the top wall being rotatably coupled to the at least one side wall so as to form a closeable opening in the enclosure; and (b) a plurality of divider members comprising a first divider defining within the enclosure a cylindrically shaped compartment dimensioned for containing a plurality of marker cones and a second divider defining within the enclosure a rectangular compartment, the first divider being rigid and removably attachable to the at least one side wall.

The rectangular compartment may be dimensioned for containing a first aid kit. The plurality of divider members may define within the enclosure a second the rectangular compartment dimensioned for containing pinnies. The second divider may be flexible. The second divider may be removably attachable to the at least one side wall. The apparatus may include a cooler. The apparatus may include a pocket attached to the top wall. The pocket may be accessible from the interior of the enclosure. The pocket may be dimensioned for containing a player card.

Other aspects and features of the present invention will become apparent to those of ordinary skill in the art upon review of the following description of embodiments of the invention in conjunction with the accompanying figures and claims.

BRIEF DESCRIPTION OF THE DRAWINGS

In drawings which illustrate by way of example only embodiments of the invention.

DETAILED DESCRIPTION

An apparatus for containing sports equipment includes: enclosure means for enclosing said sports equipment; and access means for permitting access to said enclosure means. The apparatus may include divider means for defining compartments within said enclosure means.

Figure 1:
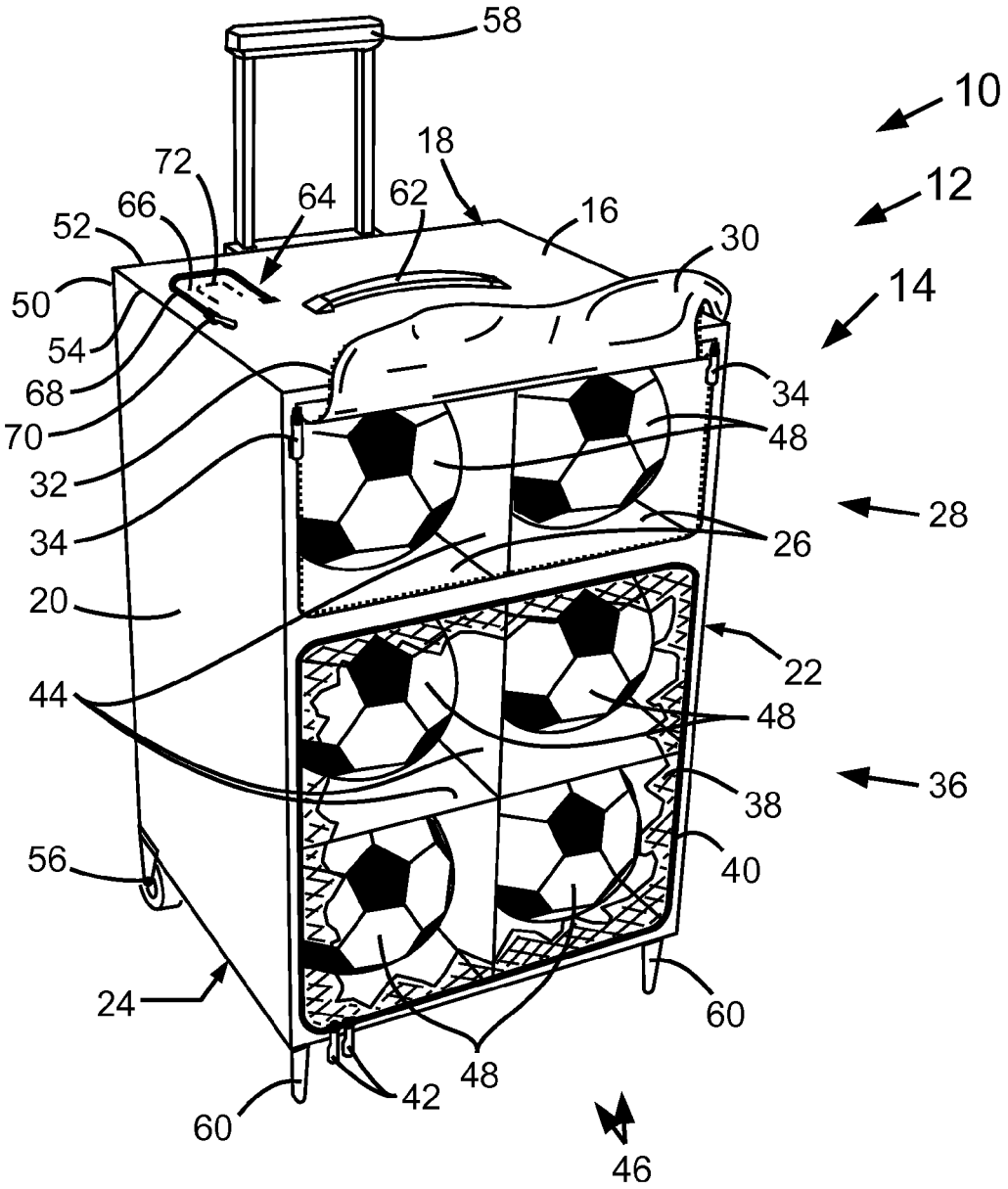
FIG. 1 is a perspective view of an apparatus for containing sports equipment according to a first embodiment of the invention.

Referring to FIG. 1, the apparatus according to a first embodiment of the invention is shown generally at 10. The apparatus 10 is operable to contain sports equipment and is suitable for use in transporting sports equipment, including transporting sports equipment typically used by coaches to and from a sports field or other facility for games and training sessions.

Examples of sports equipment that is transportable using the apparatus 10 include: soccer balls and/or balls for other sports, pinnies, cones, corner flags, field markers, goal markers, goal pieces, goal nets, goal net fasteners, ball pumps, goalie gloves and other athletic wear accessories, player cards, first aid kits, coolers, ice for first aid treatment, gel packs for first aid treatment, other similar items and any combination thereof. The apparatus 10 in accordance with various embodiments of the invention may be variously dimensioned for suitably transporting the sports equipment related to a particular sport, such as soccer, football, rugby, basketball or volleyball for example.

As shown in FIG. 1, the apparatus 10 includes a plurality of walls 12 defining an enclosure 14 within the apparatus 10. The plurality of walls 12 includes a top wall 16, a rear wall 18 (not visible in FIG. 1), opposing side walls 20 and 22 (not visible in FIG. 1) and a bottom wall 24 (not visible in FIG. 1).

In the first embodiment, the apparatus 10 also includes a section wall 26 which divides the enclosure 14 into an upper section 28, which is closeable by an upper front cover 30 and an upper zipper 32 having upper sliders 34; and a lower section 36, which is closeable by a lower front cover 38 and a lower zipper 40 having lower sliders 42.

In FIG. 1, the upper section 28 is shown opened and the lower section 36 is shown closed. For ease of illustration, FIG. 1 shows a cut-out of the mid-section of the lower front cover 38. In the first embodiment, the upper front cover 30 is made of a fabric, such as a nylon fabric material or similar, and is opaque, while the lower front cover 38 is made of a mesh fabric, such as a nylon mesh material or similar, and is thereby see-through or otherwise translucent. The see-through nature of the lower front cover 38 advantageously permits viewing of the contents of the lower section 36 when closed by the lower front cover 38. It will be appreciated by a person of ordinary skill in the art, however, that the upper front cover 30 and the lower front cover 38 may be made of any combination of a variety of suitable materials, including water-resistant, moisture-resistant, waterproof and waterproof treated materials for example. While the first embodiment includes the upper and lower zippers 32 and 40, it will be appreciated that any suitable fastener may be employed, including hook-and-loop fastener, hole-type button, snap-type button, clip, clamp, strap, belt, drawstring, and any combination thereof for example.

The first embodiment includes at least one divider 44 suitable for dividing the enclosure 14 into one or more compartments 46. As shown in FIG. 1, the upper section 28 is divided by a single divider 44 into two left and right compartments 46; whereas the lower section 36 is divided by a pair of perpendicularly disposed dividers 44 four upper-left, upper-right, lower-left and lower-right compartments 46.

In the first embodiment, the apparatus 10 is advantageously dimensioned such that each compartment 46 is suitable for containing one or more sports balls, such as the soccer balls 48 shown in FIG. 1. As best seen when viewing the side wall 20 of FIG. 1, each compartment 46 in the first embodiment is dimensioned for receiving two soccer balls 48 (the soccer balls 48 closest to the rear wall 18 are not visible in FIG. 1) such that the apparatus 10 is advantageously dimensioned for containing up to 12 soccer balls. In such embodiment, the apparatus 10 is advantageously and particularly suited for containing up to 12 standard size 5 soccer balls when the enclosure 14 has a height of 27 inches (686 mm) along the vertical edge 50, a width of 18 inches (457 mm) along the horizontal edge 52 and a depth of 17 inches (432 mm) along the edge 54, typically plus or minus one-quarter inch (6 mm).

Further embodiments may be advantageously suited for containing a particular number of balls of a particular type. By way of example, the apparatus 10 in accordance with some embodiments may have a height of 36 inches (914 mm) along the vertical edge 50, typically plus or minus one-quarter inch (6 mm), or may otherwise be suitably dimensioned for containing up to 16 standard size 5 soccer balls. In a half-width variation of the first embodiment, the apparatus 10 may be dimensioned to have a width of approximately 9 inches (229 mm) along the horizontal edge 52 such that the apparatus 10 is dimensioned to contain half the number of balls as the corresponding 18 inch (457 mm) width embodiment. Other dimensions are possible.

The apparatus 10 in accordance with the first embodiment is advantageously operable to contain sports equipment other than balls. In particular, the apparatus 10 as shown in FIG. 1 is suitable for containing in any one or more of the compartments 46 a number of items of sports equipment, each item not being appreciable larger than two soccer balls. Other types of balls of similar or smaller size than a soccer ball, pinnies, cones, corner flags, field markers, goal markers, suitably sized goal pieces, goal nets, goal net fasteners, ball pumps, goalie gloves and other athletic wear accessories, player cards, first aid kits, coolers, ice for first aid treatment, gel packs for first aid treatment, other similar items and any combination thereof for example may be suitably placed in the compartments 46 in place of one or more of the soccer balls 48. In the embodiment shown in FIG. 1, the 2 compartments 46 of the upper section 28 are advantageously suitable for containing up to 4 standard size 5 soccer balls or at least 50 marker cones (not shown in FIG. 1), at least 25 pinnies (not shown in FIG. 1) and a first aid-kit (not shown in FIG. 1).

In various embodiments, the apparatus 10 may be advantageously dimensioned for particular types or sizes of balls, including size 3 soccer balls, size 4 soccer balls, size 5 soccer balls, other sizes of soccer balls, standard sized balls other than soccer balls, non-standard sized balls, and any combination thereof for example. The compartments 46 of a given embodiment need not all have the same dimensions.

Still referring to FIG. 1, the apparatus 10 in accordance with the first embodiment includes a pair of wheels 56 (one of which is visible in FIG. 1) disposed at opposed rearward ends of the bottom wall 24, a retractable telescoping handle 58 and support feet 60, and is advantageously operable to stand upright. At, adjacent to or otherwise near to the wheels 56 along any one or more of the rear wall 18, the side walls 20 and 22 and the bottom wall 24, the apparatus 10 includes in some embodiments at least semi-rigid material for imparting structural stability to the apparatus 10. Such stabilizing material may be made of plastic, adhesive, metal and any combination thereof for example, and may be rigid. While such stabilizing material may extend along the entire surface of one or more walls 12, it need not do so and substantial portions of one or more walls 12 may be made of a flexible material such as a fabric.

The apparatus 10 of FIG. 1 also includes a handle 62, which may be rigid and/or flexible and may be slidably attached to the top wall 16 for extending from the top wall 16 when in use. While not shown in FIG. 1, the apparatus 10 may include additional handles, such as handles similar to the handle 62, on any one or more of the side walls 20 and 22 and the bottom wall 24 for example. While the handle 58 is shown in FIG. 1 as a retractable telescoping handle and the handle 62 is shown in FIG. 1 as a static loop-type handle, other types of handles may be employed. For example, either or both of the handle 58 and the handle 62 may be a flip-type handle. By way of further example, the handle 58 may be a static handle, including a static loop-type handle similar to the handle 62.

The apparatus 10 of the first embodiment includes a pocket 64 formed by a flap 66 which is closeable by a pocket zipper 68 having a pocket slider 70. The pocket 64 in the first embodiment includes an inner pocket 72 shown by dashed line in FIG. 1 as indication that the inner pocket 72 in the first embodiment is attached to the inner side of the flap 66. In the first embodiment, at least one of the pocket 64 and the inner pocket 72 is advantageously suitable for containing player cards, including player substitution slips. While the pocket 64 and the inner pocket 72 are shown notably smaller in size than the area of the top wall 16, the pocket 64 may extend along any portion thereof including along the entire area of the top wall 16, for example. The apparatus 10 may include other pockets, including side pockets, which may be outer side pockets and/or inner side pockets, for example.

Figure 2:
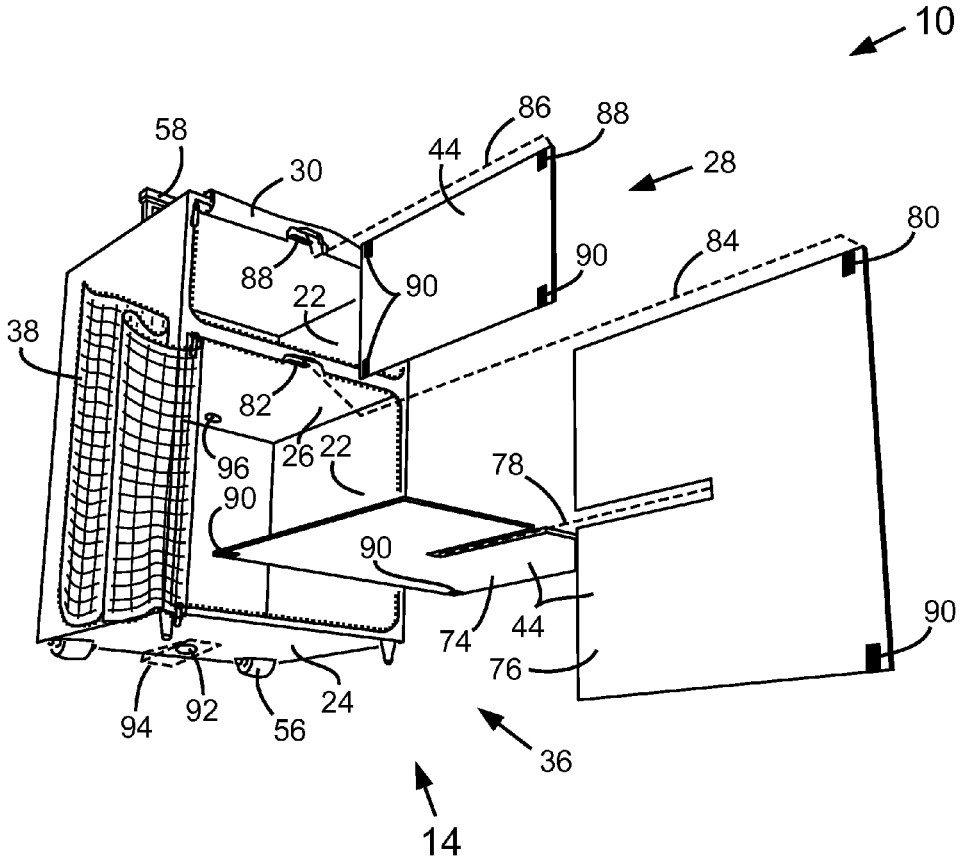
FIG. 2 is a perspective view of the apparatus shown in FIG. 1, showing dividers of the apparatus.

Referring to FIG. 2, one or more of the dividers 44 may be removable from the enclosure 14 of the apparatus 10. In the first embodiment of FIGS. 1 and 2, the pair of perpendicularly disposed dividers 44 of the lower section 36 includes a first divider 74 and a second divider 76, each of which includes slots for engaging the first and second dividers 74 and 76 together as shown by the dashed line 78 to form an expanded configuration. In various embodiments, the first and second dividers 74 and 76 may be identical, similar or different from each other.

As shown in FIG. 2, the second divider 76 includes a first patch 80 and the section wall 26 has attached thereto a second patch 82 such that the first and second patches 80 and 82 form a hook-and-loop fastener. As indicated by the dashed line 84 in FIG. 2, the second divider 76 at its first patch 80 can be moved along the dashed line 84 until the first patch 80, particularly at its top portion (not visible in FIG. 2), contacts the second patch 82 and secures the second divider 76 in place. To form four compartments 46 within the lower section 36, the first and second dividers 74 and 76 are engaged with each other prior to fastening the second divider 76 within the enclosure 14.

The single divider 44 of the upper section 28 can also be fastened within the enclosure 14 in a similar fashion, as indicated by the dashed line 86, using the hook-and-loop fastener 88.

FIG. 2 shows the second patch 82 mid-way along the horizontal width of the apparatus 10 and extending minimally on either side of such mid-way. However, the second patch 82 may extend further than shown in FIG. 2, including extending along the entire width of the apparatus 10 or around the entire perimeter of the lower section 36 for example.

In variations, any one or more of additional patches 90 forming additional hook-and-loop fasteners may be added to the dividers 44 and the walls 12 for enhanced structural stability of the apparatus 10 when the dividers 44 are installed and/or for rotational symmetry of the dividers 44 such that the dividers 44 can advantageously be installed in multiple orientations. For example, a hook-and-loop fastener patch (not visible in FIG. 2) may be installed at the bottom of the lower section 36 opposite the patch 82 for engaging a corresponding patch 90 on the second divider 76 to more securely hold the second divider 76 in place. Similarly, a hook-and-loop fastener may be installed for use at the bottom of the upper section 28. In some embodiments, a hook-and-loop fastener patch (not shown) extends around the entire perimeter of the upper section 28, for example. By way of another example, additional patches 90 attached to the upper divider 44 that are shown in FIG. 2 as being rearward oriented may form part of an additional hook-and-loop fastener within the enclosure 14 near the rear wall 18 for more securely holding the upper divider 44 in place within the upper section 28. By way of further example, the second divider 76 can be oriented such that either of the patches 80 and 90 of the second divider 76 fastenably engage with the second patch 82, thereby advantageously permitting the second divider 76 to be installed in multiple orientations. By way of further example, the first and second dividers 74 and 76 may include corresponding patches 80 and 90 such that the first and second dividers 74 and 76 are interchangeable with each other.

In the first embodiment, the apparatus 10 includes one or more drains such as the drain hole 92 shown in FIG. 2. In some embodiments, a mesh material (not shown) extends across the drain hole 92. Some embodiments include a drain guard such as the splash guard 94 shown by dashed line in FIG. 2. An additional drain hole 96 may be included for draining the upper section 28, and some embodiments include a channel, tube or other guide (not shown) for directing drain water from the additional drain hole 96 toward the drain hole 92. While FIG. 2 shows the drain hole 92 at the bottom wall 24, the drain hole 92 may be located in any suitable location, including at the rear wall 18, such as at the rear wall 18 near or adjacent to the bottom wall 24. Additionally or alternatively, the drain hole 92 may be located at the junction of the bottom wall 24 and the rear wall 18 for example. Generally, the drain hole 92 is located at the bottom end of the apparatus 10. In some embodiments, there are multiple drain holes 92, for example. Each splash guard 94 may be implemented by a grommet (not shown), for example.

In the first embodiment shown in FIGS. 1 and 2, the top wall 16, side walls 20 and 22 and the bottom wall 24 are advantageously foldable, and may be foldable relative to the rear wall 18. In the first embodiment, the apparatus 10 is advantageously collapsible, such as by laying the top wall 16, side walls 20 and 22 and the bottom wall 24 adjacent and substantially parallel to the rear wall 18. Each of the top wall 16, side walls 20 and 22, bottom wall 24 and the section wall 26 in the first embodiment is substantially made of a flexible material, such as a fabric, for ease of folding the apparatus 10 to its collapsed state. Preferably, the rear wall 18 is at least semi-rigid, such as by including a plastic material within a fabric liner of the rear wall 18, to advantageously impart structural stability to the apparatus 10 when in operation and when in its collapsed state. In the first embodiment, the dividers 44 are at least semi-rigid and may be rigid such that the apparatus 10 is advantageously at least structurally semi-rigid when the dividers 44 are installed within the enclosure 14. By advantageously permitting the dividers 44 to be removed from the enclosure 14, disengaged from each other, and stacked adjacent and substantially parallel to the rear wall 18, the entire apparatus 10 is advantageously collapsible to a substantially planar and rectangular shape for storage and/or shipping. In typical use, the telescoping handle 58 is fully retracted when the apparatus 10 is in its collapsed state. Disengaged and stacked dividers 14 may be stored within the enclosure 14, including when the apparatus 10 is collapsed, stored exterior to the enclosure 14, and in any combination thereof for example.

Figure 3:
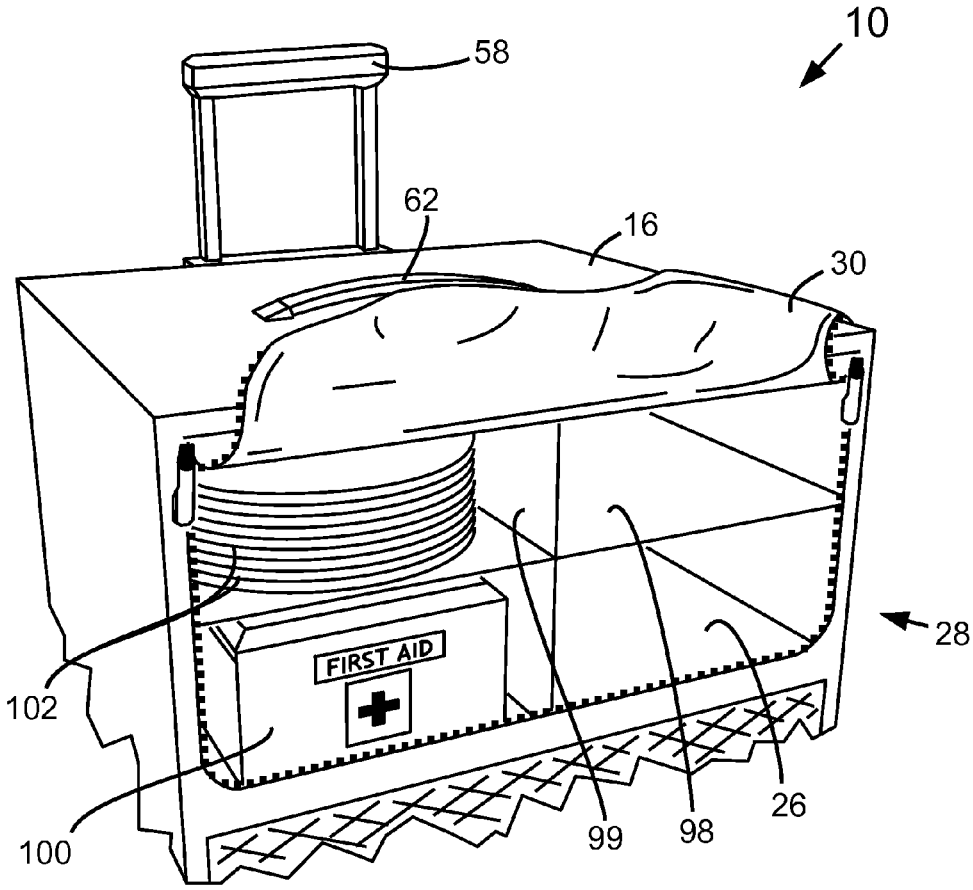
FIG. 3 is a perspective view of upper section of the apparatus shown in FIG. 1, showing an alternative set of dividers.

Referring to FIG. 3, a portion of the apparatus 10 is shown with an alternative set of dividers 44 installed in the upper section 28. In some embodiments, the alternative set of dividers 44 includes a first alternative divider 98 and a second alternative divider 99 which form a pair of removably engageable dividers 44 having slots (not visible in FIG. 3) for engaging with each other in a manner similar to that of the first and second dividers 74 and 76 (FIG. 2). The first and second alternative dividers 98 and 99 render the apparatus 10 advantageously suitable for containing in the upper section 28 shown in FIG. 3 sports equipment smaller than a standard sized ball, such as the first aid kit 100 and the marker cones 102 shown in FIG. 3. Other sports equipment that may be suitably contained include pinnies, corner flags, field markers, goal markers, suitably sized goal pieces, goal nets, goal net fasteners, ball pumps, goalie gloves and other athletic wear accessories, player cards, coolers, ice for first aid treatment, gel packs for first aid treatment, other similar items and any combination thereof.

Still referring to FIG. 3, when the first alternative divider 98 is removed, including possibly laying the first alternative divider 98 adjacent to the section wall 26 or the top wall 16, and the second alternative divider 99 is installed, the upper section 28 is preferably dimensioned for containing up to 4 soccer balls in the manner shown in FIG. 1. The embodiment of FIG. 3 is thereby advantageously configurable in a manner analogous to the embodiment of FIGS. 1 and 2. The second divider 76 (FIG. 2) and the second alternative divider 99 may be identical in shape and identical, similar or different in size, for example. While not shown, the embodiment of FIG. 3 may include the pocket 64 (FIG. 1) or similar, for example.

In some embodiments, the upper section 28 is watertight, such as by having the walls and portions thereof enclosing the upper section 28 made of water-resistant or waterproof material. For example, the apparatus 10 may not include the additional drain hole 96 and the top wall 16, section wall 26, and at least the respective portions of the side walls 20 and 22, rear wall 18 and the upper front cover 30 disposed at the upper section 28 may be made out of water-resistant or waterproof material. Embodiments in which the upper section 28 is watertight advantageously prevent water or moisture from soccer balls or other sports equipment in the lower section 36 from entering the upper section 28 and moistening the pinnies or other sports equipment being stored in the upper section 28.

Figure 4:
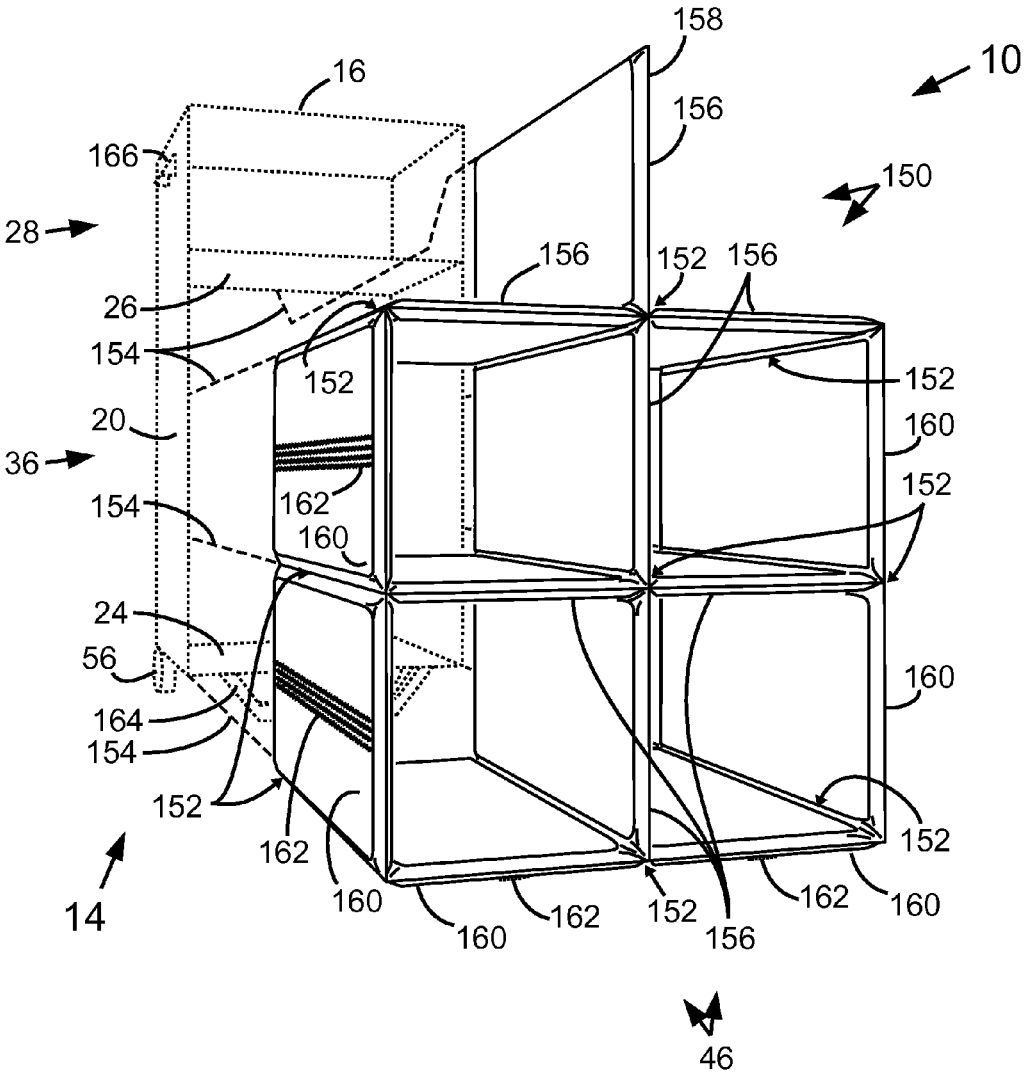
FIG. 4 is a perspective view of a variation of the apparatus shown in FIG. 1, showing foldable dividers.

Referring to FIG. 4, the apparatus 10 (a portion of which is shown by dotted lines) may include a set of foldable dividers 150 (shown by solid lines) operable to fold along the edges 152 disposed between adjacently attached foldable dividers 150. Each foldable divider 150 may be made of a rigid, semi-rigid or flexible material, or any combination thereof for example. In the variation shown in FIG. 4, each foldable divider 150 is made of a fabric-covered compressible material. By way of example, the fabric may be a canvas or similar fabric, and the compressible material may be a foam or sponge-like material.

In some embodiments, the top wall 16 and the bottom wall 24 include a material that is substantially waterproof, and the rear wall 18, side walls 20 and 22, the upper front cover 30 (FIGS. 1 to 3) and the lower front cover 38 (FIGS. 1 and 2) include water-resistant material. The upper section 28 may be watertight.

The set of foldable dividers 150 shown in FIG. 4 is dimensioned for being inserted within the lower section 36 of the enclosure 14, such as by being inserted along dashed lines 154. In a variation, the apparatus 10 may include a further set of foldable dividers (not shown) dimensioned for being inserted within the upper section 28 of the enclosure 14. In a further variation, the apparatus 10 need not include the section wall 26 and a single set of foldable dividers may be dimensioned for being inserted within the entire enclosure 14. Other variations are possible.

The set of foldable dividers 150 shown in FIG. 4 includes seven internal divider walls 156, one of which is a free-standing divider wall 158, and six external divider walls 160, so as to define six compartments 46 when the set of foldable dividers 150 is installed within the lower section 36. The external divider walls 160 contact at least one of the walls 16, 18, 20, 22, 24 and 26 of the apparatus 10 when the set of foldable dividers 150 is installed within the lower section 36, whereas the internal divider walls 156 do not contact or merely abut the walls 16, 18, 20, 22, 24 and 26.

FIG. 4 shows the apparatus 10 having a height and other dimensions such that twelve standard sized soccer balls can be stored within the lower section 36. While FIG. 4 shows the set of foldable dividers 150 positioned for being inserted with the free-standing divider wall 158 perpendicularly abutting the section wall 26, the set of foldable dividers 150 shown in FIG. 4 has 180 degree rotational symmetry to permit insertion into the lower section 36 such that the free-standing divider wall 158 perpendicularly abuts the bottom wall 24. In a variation (not shown), six compartments 46 may be defined by a set of foldable dividers 150 having ten external divider walls 160, seven internal divider walls 156 and no free-standing divider wall 158. In a further variation (not shown), six compartments 46 may be defined by a set of foldable dividers 150 having one free-standing divider wall 158 disposed between a pair of fully enclosing divider sections having each three internal divider walls 156 and four external divider walls 160. Other variations are possible.

In the embodiment shown in FIG. 4, the apparatus 10 includes at least one fastener, such as the hook-and-loop fasteners 162, for fastening the set of foldable dividers 150 within the enclosure 14. Corresponding hook-and-loop fastening elements within the enclosure 14 are not visible in FIG. 4. Preferably, the set of foldable dividers 150 includes one patch of a hook-and-loop fastener 162 for each external divider wall 160.

The set of foldable dividers 150 are operable to fold at least at the edges 152 so as to collapse from the expanded configuration shown in FIG. 4 to a substantially planar configuration (not shown). By appropriately collapsing the set of foldable dividers 150, the collapsed dividers 150 may be stored within the enclosure 14, including when the apparatus 10 is collapsed.

FIG. 4 also shows a lower handle 164 (in dotted outline), which acts as the support feet 60 (FIG. 1) and advantageously also facilitates gripping the apparatus 10 by hand. For example, the apparatus 10 can be gripped at the lower handle 164 when it is being carried, such as being carried up a flight of stairs.

FIG. 4 shows a side handle 166 (in dotted outline). A second side handle 166 on the opposing side of the apparatus 10 is not visible in FIG. 4.

Figure 5:
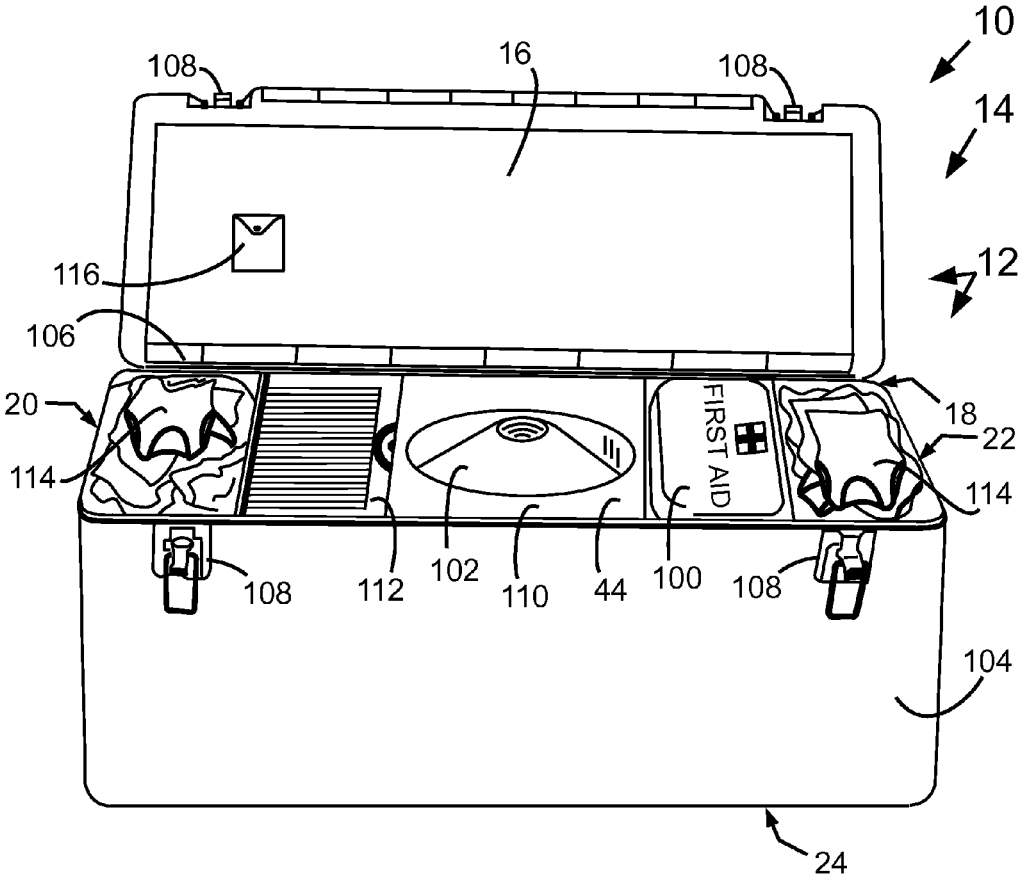
FIG. 5 is a perspective view of an apparatus for containing sports equipment according to a second embodiment of the invention, showing a non-planar divider.

Referring to FIG. 5, the apparatus 10 in accordance with a second embodiment includes a front wall 104. The top wall 16, rear wall 18 (not visible in FIG. 5), side walls 20 and 22 (neither visible in FIG. 5), bottom wall 24 (not visible in FIG. 5) and the front wall 104 of the embodiment of FIG. 5 are shown as being rigid, such as may result from use of an injection molding manufacturing technique. However, in a variation of the second embodiment, any one or more of the walls 16, 18, 20, 22, 24 and 104 may be made of any combination of rigid, semi-rigid and flexible materials, including for example fabric-covered plastic. In some embodiments, the apparatus 10 is made of a rigid or semi-rigid frame covered by a flexible material such as a fabric.

The apparatus 10 as shown in FIG. 5 includes a hinge 106 for hingedly connecting the top wall 16 to the rear wall 18, and a fastener such as the pair of clamps 108 for releasably closing the enclosure 14. Additionally or alternatively, the enclosure 14 may be fastened by any suitable means, including by one or more of a zipper, hook-and-loop fastener, hole-type button, snap-type button, clip, strap, belt, drawstring, and any combination thereof for example.

The divider 44 shown in FIG. 5 is a non-planar divider 110 which is preferably at least semi-rigid and may be rigid. In some embodiments, the non-planar divider 110 is a unitary piece defining a plurality of compartments 46 suitable for containing sports equipment. The non-planar divider 110 of the embodiment shown in FIG. 5 includes a cylindrical compartment 46 suitable for containing marker cones 102; a rectangular compartment 46 suitable for containing a first aid kit 100; a cooler 112 suitable for containing first aid treatment ice or gel packs; and two rectangular compartments 46 suitable for containing pinnies 114 or other items. The non-planar divider 110 may have any suitable height, including having a height coincident with one or more of the front wall 104, rear wall 18 and the side walls 20 and 22.

While not limiting the permitted size and shape of the apparatus 10, suitable dimensions for the apparatus 10 of FIG. 5 may include a height between 9 inches (229 mm) and 11 inches (279 mm), a length of 28 inches (711 mm) and a width of 9 inches (229 mm) or variations thereof. By way of further example, the apparatus 10 of FIG. 5 may be dimensioned to fit within the upper section 28 of the apparatus 10 of FIGS. 1 to 4, such as when the dividers 44 (FIGS. 1 to 2), 98 and 99 (FIG. 3) have been removed from the upper section 28 and typically with a clearance adequately, but not excessively, sufficient for ease of entry and removal of the apparatus 10 of FIG. 5 from the upper section 28 shown in FIGS. 1 to 4.

In some embodiments, the apparatus 10 includes an opening such as the pocket 116 shown in FIG. 5 for containing player cards, including player substitution slips. The pocket 116 may be of any suitable size, including a different size than that shown in FIG. 5 such as being at least 14 inches (356 mm) by 9 inches (229 mm) and/or large enough to hold paper sheets of a standard size such as 11 inches (279 mm) by 8.5 inches (216 mm). While FIG. 5 shows one pocket 116 attached to the top wall 16 at its inner surface, any number of pockets 116 may be disposed in any suitable manner within the enclosure 14 and/or at an outer surface of one or more walls 12.

In some embodiments, the non-planar divider 110 is removable from the enclosure 14. The apparatus 10 may include one or more fasteners (not shown) for securing the non-planar divider 110 within the enclosure 14, typically without impeding the enclosure 14 from being closed.

The apparatus 10 of the second embodiment is preferably stackable. While not visible in FIG. 5, stackability may be achieved by including tabs or other projections and/or grooves, channels or other recesses at the outer surfaces of the top wall 16 and the bottom wall 24 such that the apparatus 10 and another apparatus 10 stackably interfit.

Figure 6:
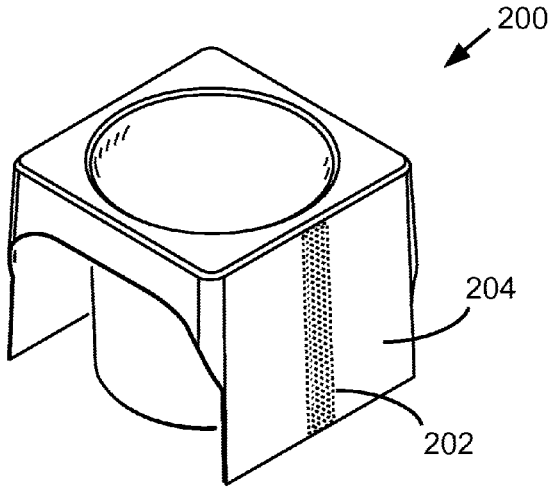
FIG. 6 is a perspective view of a cone holder for use with the apparatus shown in FIG. 5, showing a full length side wall.
Figure 7:
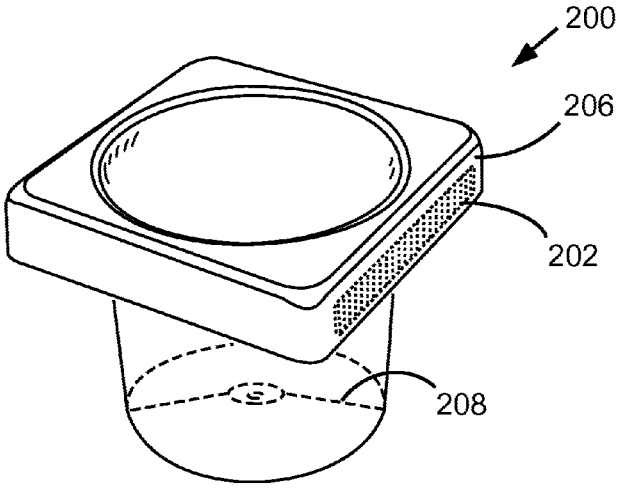
FIG. 7 is a perspective view of a variation of the cone holder shown in FIG. 6, showing an upper side wall.

Referring to FIGS. 6 and 7, the apparatus 10 in accordance with variations of the second embodiment (FIG. 5) includes a cone holder 200, which defines a cylindrical compartment 46 dimensioned for containing marker cones 102 (FIG. 5). The cone holder 200 is preferably unitary. In some embodiments, the cone holder 200 is rigid, such as may result from use of a injection molding manufacturing technique to make the cone holder 200 out of a plastic material, including possibly a deformable plastic material. The cone holder 200 shown in FIGS. 6 and 7 includes a fastener, such as the hook-and-loop fastener 202, for removably securing the cone holder 200 within the apparatus 10. While FIGS. 6 and 7 show one hook-and-loop fastener 202 for each cone holder 200, the cone holder 200 may include any number of fasteners, including having two hook-and-loop fasteners 202 at opposing sides of the cone holder 200 or four hook-and-loop fasteners 202 on all four sides of the cone holder 200.

The hook-and-loop fastener 202 shown in FIG. 6 is oriented vertically along a cone holder side wall 204 which extends substantially along the entire height of the cone holder 200 of FIG. 6. In the variation of FIG. 7, the hook-and-loop fastener 202 is oriented horizontally along the cone holder upper side wall 206.

FIG. 7 shows in dashed line the cone holder 200 having a raised bottom 208, which advantageously conforms to the shape of the underneath of stackable marker cones 102 (FIG. 5). In variations, the cone holder 200 of either FIG. 6 or FIG. 7 may have a substantially flattened bottom (FIG. 6) or the raised bottom 208 of FIG. 7.

The cone holder 200 of FIGS. 6 and 7 may be suitably used with the apparatus 10 in accordance with variations of the second embodiment in which any combination of the walls 16, 18, 20, 22, 24 and 104 are made of a non-rigid material such as a fabric, water-resistant fabric, waterproof fabric or any combination thereof. The cone holder 200 of FIGS. 6 and 7 may also be suitably used with the apparatus 10 in accordance with variations of the second embodiment not having the hinge 106 (FIG. 5), in which the top wall 16 is foldably attached or otherwise rotatably coupled to the rear wall 18, such as by the top wall 16 and the rear wall 18 being made of a flexible material such as a fabric.

While not shown in FIGS. 5 to 7, all of the walls 16, 18, 20, 22, 24 and 104 of the apparatus 10 in accordance with variations of the second embodiment may be made of a flexible material, such as a canvas or similar for example. The apparatus 10 in accordance with variations of the second embodiment may include one or more dividers (not shown) made of a semi-rigid or flexible material, including a fabric material, defining one or more rectangular compartments 46 suitable for containing a first aid kit 100 (FIG. 5), a cooler, pinnies 114 (FIG. 5), other items of sports equipment or any combination thereof for example. Dividers of the apparatus 10 in accordance with variations of the second embodiment may be removably attachable to the apparatus 10, including having fasteners, such as hook-and-loop fasteners, for removably securing such dividers to the walls 18, 20, 22, 24 and 104 of the apparatus 10. For example, hook-and-loop fasteners on opposing sides of the dividers may be used to removably attach the dividers to the rear wall 18 and the front wall 104. The apparatus 10 in accordance with variations of the second embodiment may include a cooler, including a cooler made of flexible material, and/or other sports equipment. While not shown in FIGS. 5 to 7, all the walls 18, 20, 22, 24 and 104 and all the dividers separate from the cone holder 200 of the apparatus 10 in accordance with the second embodiment may be made of a flexible material. In variations of the apparatus 10 in accordance with the second embodiment, the top wall 16 and the bottom wall 24 include a material that is substantially waterproof and the rear wall 18, side walls 20 and 22 and the front wall 104 include a water-resistant material.

Thus, there is provided an apparatus for containing sports equipment, the apparatus comprising: (a) at least one wall defining an enclosure and a closeable opening in the enclosure, the at least one wall being see-through at the closeable opening when the closeable opening is closed; and (b) a plurality of divider members configurable to an expanded configuration defining within the enclosure a plurality of compartments and configurable to a substantially planar collapsed configuration, each of the compartments being dimensioned for receiving at least one item of the sports equipment, the divider members being removably insertable into the enclosure when in the expanded configuration and when in the collapsed configuration.

The apparatus 10 as described and illustrated herein may be sold by itself, or as part of a kit containing the apparatus 10 and one or more items of sports equipment, including one or more soccer balls and/or other types of balls, pinnies, cones, corner flags, field markers, goal markers, goal pieces, goal nets, goal net fasteners, ball pumps, goalie gloves and other athletic wear accessories, player cards, a first aid kit, a cooler, gel packs for first aid treatment and any combination thereof for example.

While embodiments of the invention have been described and illustrated, such embodiments should be considered illustrative of the invention only. The invention may include variants not described or illustrated herein in detail. Thus, the embodiments described and illustrated herein should not be considered to limit the invention as construed in accordance with the accompanying claims.

What is claimed is:

1. An apparatus for containing sports equipment, the apparatus comprising:

(a) a bottom wall, a top wall, and at least one side wall extending between said bottom wall and said top wall so as to define an enclosure, said top wall being rotatably coupled to said at least one side wall so as to form a closeable opening in said enclosure; and (b) a plurality of divider members within said enclosure, comprising:

a first divider comprising;

a wall substantially completely defining a cylindrical compartment dimensioned for containing a plurality of marker cones; and a lip extending outward from an upper end of said cylindrical compartment to prevent other items from falling around the sides of the compartment, and further comprising at least one projection extending downward from said lip; and a fastener associated with said lip to removably attach said first divider to at least one side wall, wherein said fastener is mounted on said projection; and a bottom to rest against said bottom wall, wherein said bottom is raised to conform to the shape of said marker cones; and a second divider defining a rectangular compartment.

2. The apparatus of claim 1 wherein said rectangular compartment is dimensioned for containing a first aid kit, and wherein said plurality of divider members define within said enclosure a second rectangular compartment.

3. The apparatus of claim 1 wherein said second divider is flexible and removably attachable to said at least one side wall.

4. The apparatus of claim 1 further comprising a cooler.

5. The apparatus of claim 1 further comprising a pocket attached to said top wall, said pocket being accessible from the interior of said enclosure.

6. The apparatus of claim 1 further comprising at least a second rectangular compartment defined by said plurality of divider members.

7. The apparatus of claim 6 wherein said second divider is flexible and removably attachable to said at least one side wall.

8. The apparatus of claim 6 wherein said second rectangular compartment is defined by a third divider.

9. The apparatus of claim 8 wherein said third divider is flexible and removably attachable to said at least one side wall.

* * * * *